United States Patent [19]

Petralia et al.

[11] Patent Number: 4,686,736

[45] Date of Patent: Aug. 18, 1987

[54] VACUUM CLEANER

[75] Inventors: Salvatore Petralia, Sayreville; H. Gerald Young, South Plainfield, both of N.J.

[73] Assignee: The Regina Co., Inc., Rahway, N.J.

[21] Appl. No.: 832,510

[22] Filed: Feb. 19, 1986

[51] Int. Cl.[4] ..... A47L 5/32

[52] U.S. Cl. ..... 15/332; 15/334; 15/390

[58] Field of Search ..... 15/331, 332, 390, 334

[56] References Cited

U.S. PATENT DOCUMENTS

| | | | |
|---|---|---|---|
| 1,438,890 | 12/1922 | Bobst . | |
| 2,148,656 | 2/1939 | Smellie . | |
| 2,175,004 | 10/1939 | Snyder . | |
| 2,210,950 | 8/1940 | Replogle . | |
| 2,210,953 | 8/1940 | Replogle . | |
| 2,250,282 | 7/1941 | Swann . | |
| 2,253,309 | 8/1941 | Smellie . | |
| 2,287,922 | 6/1942 | White | 15/332 |
| 2,487,443 | 11/1949 | Hough | 15/332 |
| 2,601,698 | 7/1952 | Humphrey | 15/390 |
| 2,648,396 | 8/1953 | Kirby . | |
| 2,763,887 | 9/1956 | Brace | 15/361 |
| 2,898,621 | 8/1959 | Vance | 15/334 X |
| 2,898,622 | 8/1959 | Hurd | 15/333 |
| 3,879,797 | 4/1975 | Principe et al. | 15/334 |
| 4,217,674 | 8/1980 | Hayashi et al. | 15/361 |
| 4,446,594 | 5/1984 | Watanabe et al. | 15/323 |
| 4,446,595 | 5/1984 | Nakada et al. | 15/390 X |

FOREIGN PATENT DOCUMENTS

| | | | |
|---|---|---|---|
| 531804 | 10/1956 | Canada | 15/332 |
| 2000047 | 8/1969 | France | 15/332 |

*Primary Examiner*—Chris K. Moore

*Attorney, Agent, or Firm*—Martin Lukacher

[57] ABSTRACT

A vacuum cleaner having the combined features of a canister and upright type vacuum cleaner with the canister mounted for tilting movement on a housing of a floor or nozzle unit which contains a rotatably mounted brush. A single motor is used to power a fan which creates the vacuum in the canister and to apply power to the brush through a belt and pulley assembly mounted in the floor unit housing. A hose extending from the canister is connectable and disconnectable from the floor unit housing so as to provide for above the floor cleaning when the hose is disconnected and the appropriate tools are attached thereto. When the hose is connected into the housing, the vacuum is applied to the vicinity of the brush. A mechanism for disengaging the motor from the belt and pulley assembly when above the floor cleaning is selected is provided by a cam member rotatable with the canister and a pulley asembly which is part of the belt/pulley brush drive assembly. The pulley assembly is movably mounted and biased in one direction by the belt. The cam member is engageable with the pulley assembly and moves it against the bias in the opposite direction to disengage it from the motor drive shaft. A switch is also mounted on the canister and is actuated from an "off" position when the canister is upright to "on" positions by a cam surface on the floor housing unit which is engageable with the switch such that the vacuum cleaner motor is "off" when the canister is upright and "on" when the canister is tilted forward and the brush is disconnected for above the floor cleaning operations or rearward when the motor shaft is in driving relationship with the belt/pulley assembly for floor cleaning operation.

18 Claims, 14 Drawing Figures

VACUUM CLEANER

DESCRIPTION

The present invention relates to vacuum cleaners, and particularly to improvements in convertible vacuum cleaners having the combined features of upright and canister vacuum cleaners.

The invention is especially suitable in providing a convertible vacuum cleaner which may be produced at low cost and yet provides the cleaning power and flexibility of operation of much higher priced vacuum cleaners. Features of the invention are also suitable for use in various other vacuum cleaner applications.

In order for a convertible vacuum cleaner design to be produceable at low cost, it is desirable that the same motor which drives the fan or air pump, which creates the vacuum, be used to drive the brush which agitates the floor surface (the carpet) during floor cleaning operations. It is also desirable that the vacuum pressure increase during above the floor cleaning operations. This has been accomplished in the past by various mechanisms for decoupling the air pump motor from driving relationship with the brush. Clutches have been used, as have belt shifters and other complex mechanical arrangements. See the following U.S. Pat. Nos. Bobst, 1,438,890, issued Dec. 12, 1922; Smellie, 2,148,656, issued Feb. 28, 1939; Snyder, 2,175,004, issued Oct. 3, 1939; Replogle, 2,210,950 issued Aug. 13, 1940; Replogle, 2,210,953, issued Aug. 13, 1940; Swann, 2,250,282 issued July 22, 1941; Smellie, 2,253,309, issued Aug. 19, 1941; Hough, 2,487,443, issued Nov. 8, 1949; Humphrey, 2,601,698, issued July 1, 1952; Kirby, 2,648,396 issued Aug. 11, 1953; and Hurd, 2,898,622, issued Aug. 11, 1959. It has also been suggested to provide mechanisms which raise the brush off the floor for floor cleaning operations. See Brace, U.S. Pat. Nos. 2,763,887, issued Sept. 25, 1956; Hayashi, et. al., 4,217,674, issued Aug. 19, 1980; and Watanabe, et. al., 4,446,594 issued May 8, 1984. The latter mechanisms relieve the principal part of the load on the motor which is due to the contact of the brush with the floor; however, a portion of the brush load must still be carried by the motor. The mechanisms suggested in the past are disadvantageous principally because of their cost and complexity.

It is the principal object of this invention to provide an improved vacuum cleaner which affords both floor cleaning operations, with the aid of a brush which agitates the floor's surface, as well as above the floor cleaning operations which uses the same motor for creating the vacuum and driving the brush and which automatically, without further operator assistance, decouples the brush from the drive motor when above the floor cleaning operations are selected, and which may be produced at low cost without sacrificing convenience of operation in selecting either floor cleaning or above the floor cleaning operations, and which is efficient and effective.

It is another object of the present invention to provide an improved vacuum cleaner which combines the features of an upright and canister vacuum cleaner.

It is a still further object of the present invention to provide an improved convertible vacuum cleaner having the features of upright and canister type vacuum cleaners which can be marketed at low cost and which nevertheless provides convenience of operation and efficient and effective cleaning.

Briefly described, a vacuum cleaner embodying the invention has a lower body which provides a housing having a floor cleaning brush rotatably mounted therein and an upper body, which may be a canister, which is mounted on the lower body for tilting movement about an axis. A motor and fan assembly is associated with the upper body for pulling a vacuum therein. The upper body is selectively connectable and disconnectable from the lower body, as by a hose which is attached to the upper body and which may be coupled to the lower body. The hose, when disconnected from the lower body provides for above the floor cleaning operation. When the hose is in communication with the lower body, the vacuum cleaner is conditioned for floor cleaning operation. A mechanism is provided for driving the brush using a member which is connected to the upper body and extends therefrom into the lower body. The member is disposed eccentrically with respect to the rotational axis of the upper body. It may be provided by a cam surface on a trunnion on which the upper body is mounted in the lower body. The member is moveable about an arc between the first position where the upper body is tilted in one direction (preferably rearwardly) from a given (preferably upright) position to provide for floor cleaning operations to a second position where the upper body is tilted in the opposite direction (preferably forwardly) to provide for above the floor cleaning operation.

Belt and pulley means are coupled to the brush and includes a pulley assembly which is moveably mounted in the housing. The pulley assembly has a pin and a pulley around which the belt of the belt and pulley means is entrained. The pulley assembly is mounted on the pin and has an extension. The motor has a shaft engagable with the extension of the pulley and against which the extension is biased because of the elasticity of the belt. The member is engagable with the pin when the upper body is tilted in the forward direction to move the pulley assembly away from the motor shaft and to disengage the motor shaft from the extension, thereby disconnecting driving power from the brush. The mechanism for removing the load on the motor involves very few parts.

The vacuum cleaner may be turned off when in its upright position and turned on from electric power being applied to the motor, automatically when the upper body is tilted forwardly or rearwardly. A releasable latch may be provided to retain the upper body in its upright and forward (above the floor cleaning) positions. During above the floor cleaning operations, the speed of the motor increases due to the removal of the load presented by the brush and more suction pressure is developed.

The foregoing and other objects, features and advantages of the invention will become more apparent from a reading of the following description in connection with the accompanying drawings in which.

Figure 3:
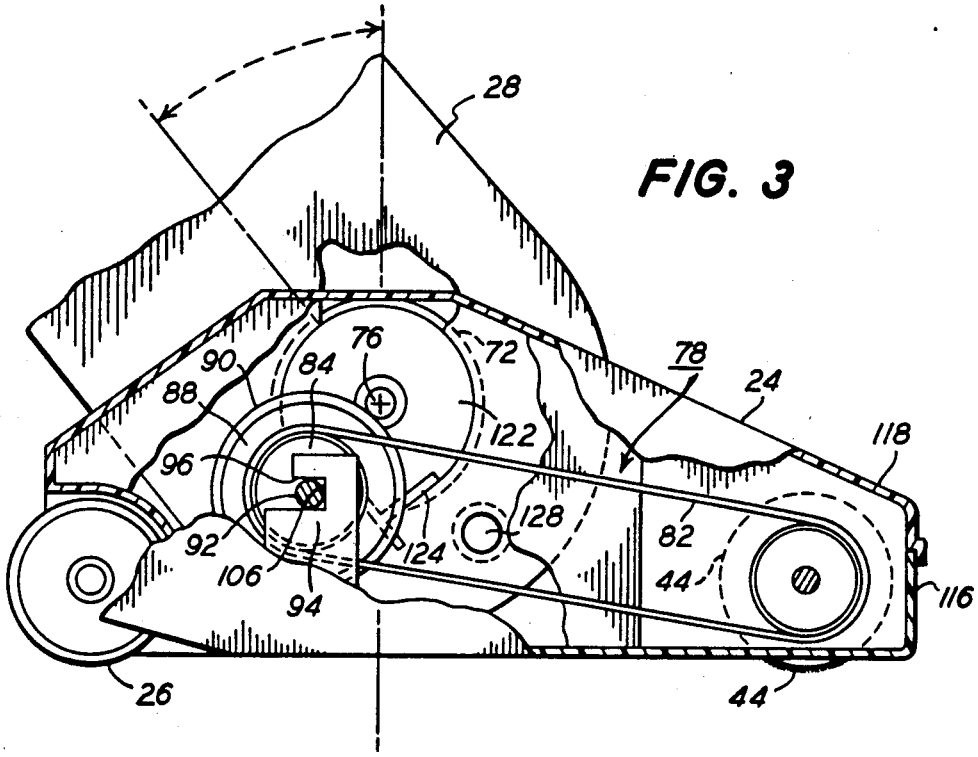
FIG. 3 is a side view of the lower portion of the vacuum cleaner illustrated in FIGS. 1 and 2, the view being taken from the left as viewed in FIG. 1 and being partially broken away to illustrate the brush drive mechanism; the canister being tilted rearwardly for floor cleaning operation.
Figure 5:
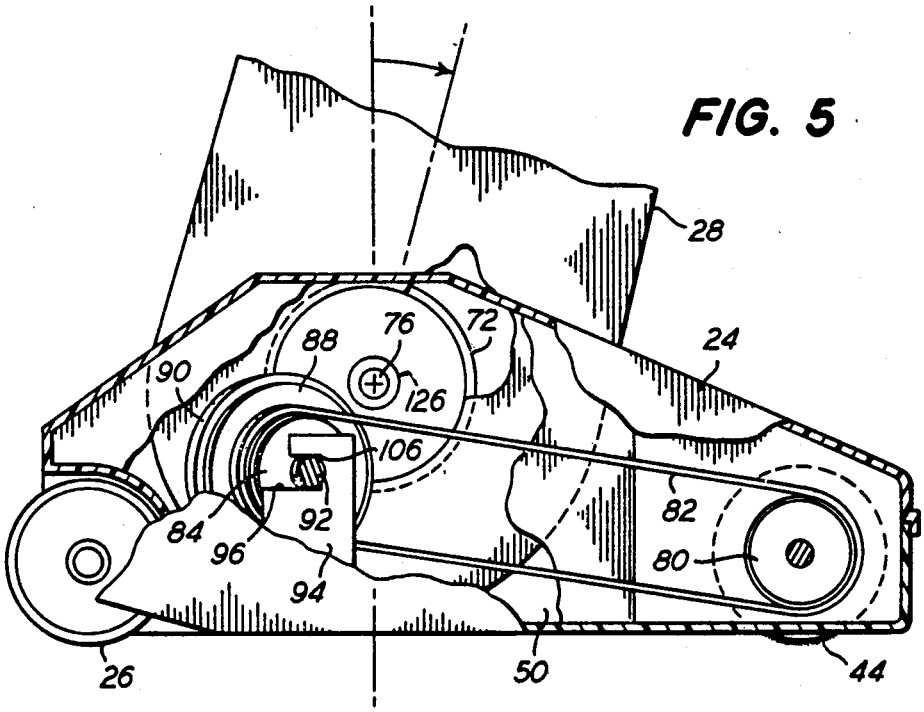
FIG. 5 is a view similar to FIGS. 3 and 4 where the canister is tilted forwardly and the parts are shown in position for above the floor cleaning where the brush is disconnected from the motor.
Figure 10:
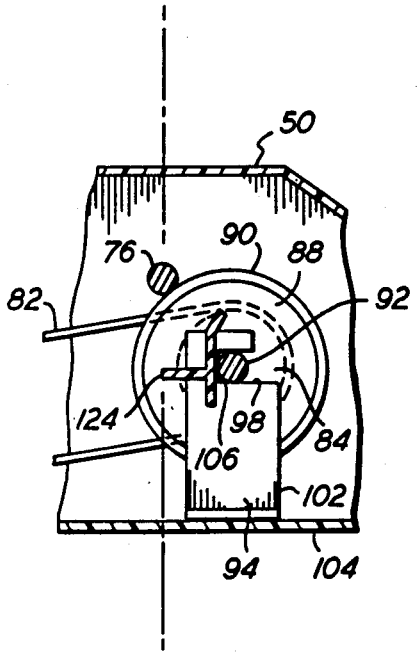
FIG. 10 is a fragmentary sectional view where the vacuum cleaner is in an off position (corresponding to FIG. 4) and showing the position of the cam member with respect to the pulley assembly of the brush drive mechanism.
Figure 12:
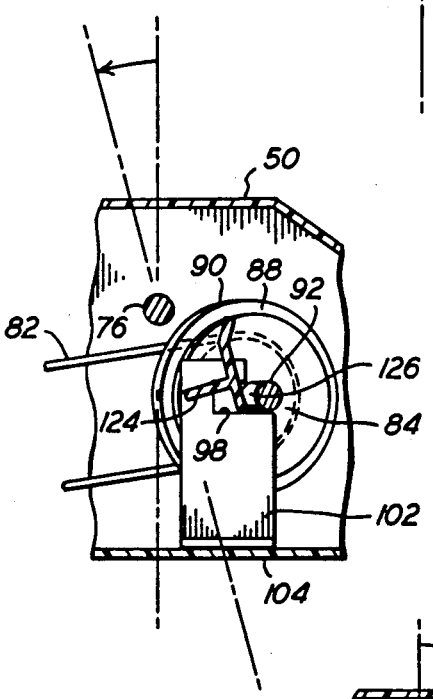
Figure 11:
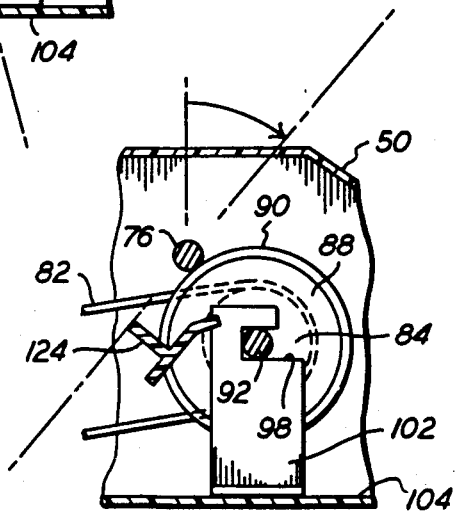

FIG. 11 is a view similar to FIG. 10 where the vacuum cleaner is in a position corresponding to that shown in FIG. 3 where the canister is tilted rearwardly for floor cleaning operations; and FIG. 12 is a view similar to FIGS. 10 and 11 and with the vacuum cleaner in the position corresponding to FIG. 5, which shows the pulley assembly and cam when the canister is tilted forwardly for above the floor cleaning operation.

Figure 1:
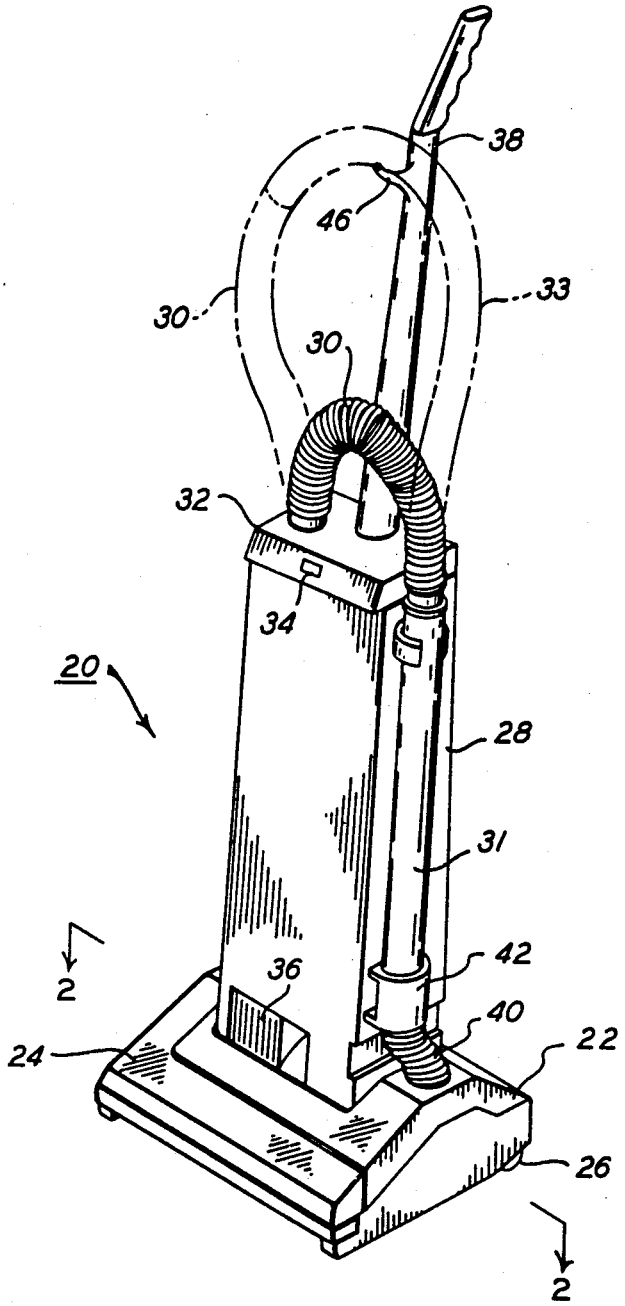
FIG. 1 is a perspective view of a vacuum cleaner embodying the invention.

Referring to the drawings and particularly to FIG. 1, there is shown a vacuum cleaner 20 having a lower body 22 provided by a housing 24. The housing is moveable about the floor on wheels 26. An upper body 28 is mounted in the housing 24 for tilting movement from an upright or vertical position, as shown in FIG. 1, rearwardly and forwardly for floor cleaning and above the floor cleaning operations, respectively. The upper body in this preferred embodiment is a hollow canister 28 which is maintained under vacuum. A hose 30 is connected to a cover 32, which is removable from the canister 28 by means of a latch which is opened when a button 34 is depressed. A removable dust collector bag, which is accessible when the cover is removed, is located near the top of the canister. The air path is through the hose 30, through the canister and out through louvres 36 near the bottom of the canister. A handle 38 is mounted on the canister cover 32. By tilting the handle 38 the canister is tilted on its mounting in the housing 24. The hose 30 preferably has a wand, tube 31 at the end opposite from the cover. The length of flexible hose between the wand 31 and cover 32 may be extended, using another hose section 33.

A hose section 40 extends upwardly from the housing and is held in a connector or coupling 42. The upper hose 30 and wand 31 assembly may be connected to the coupling 42 which then communicates the suction in the canister 28 to the floor unit housing 24, where it reaches a chamber 42 (FIG. 2) in which the brush 44 is located. When the upper hose section 30 is disconnected from the coupling 42, its free end may be connected to various cleaning tools or attachments, such as wands, crevice tools and the like and used for above the floor cleaning operations. A hook 46 on the handle 38 holds the upper hose section 33 and wand 31 assembly in place.

Figure 2:
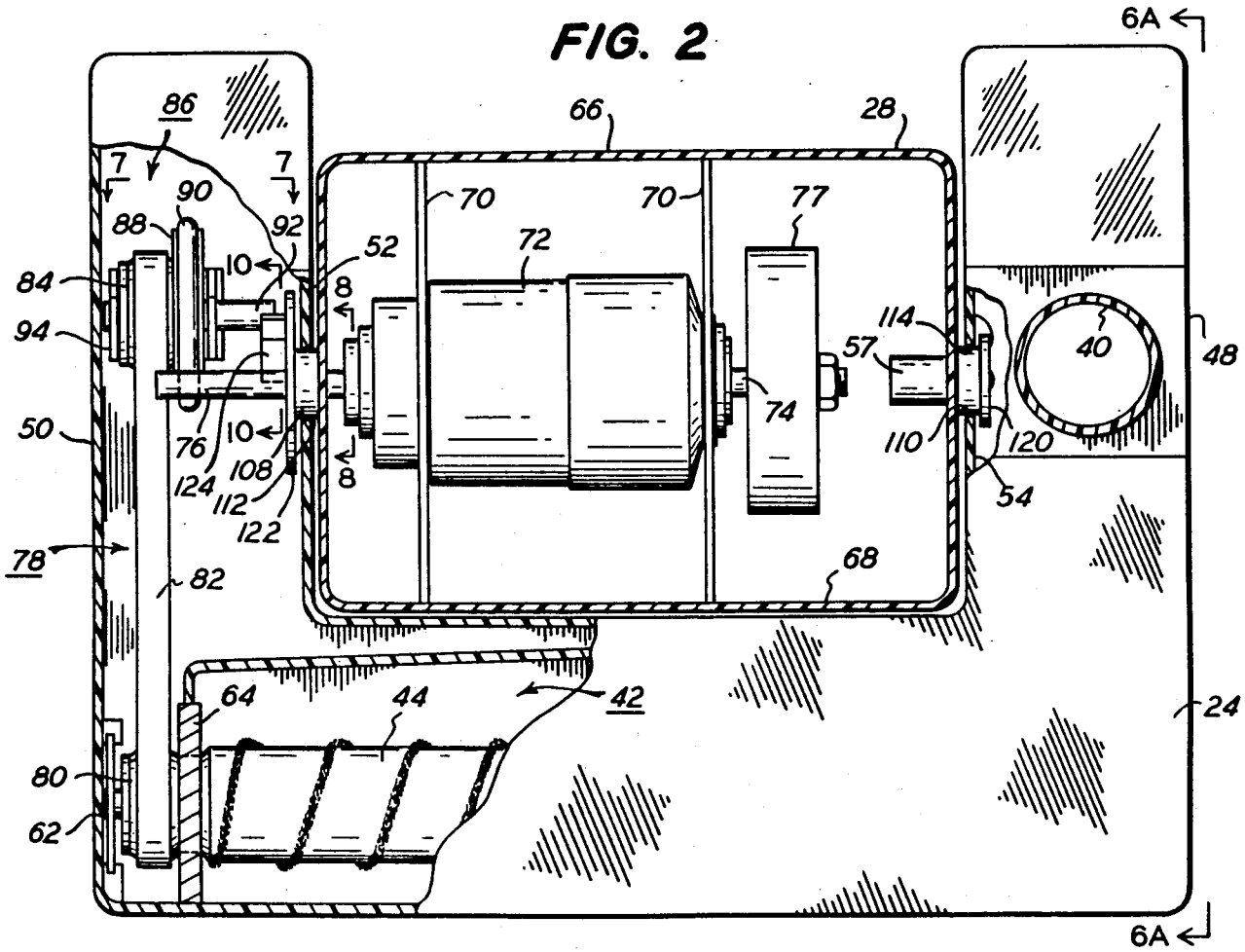
FIG. 2 is a view taken generally along line 2—2 in FIG. 1, which is partially broken away to illustrate the construction of the vacuum cleaner in the area of the bottom of the canister and in the floor unit housing.
Figure 4:
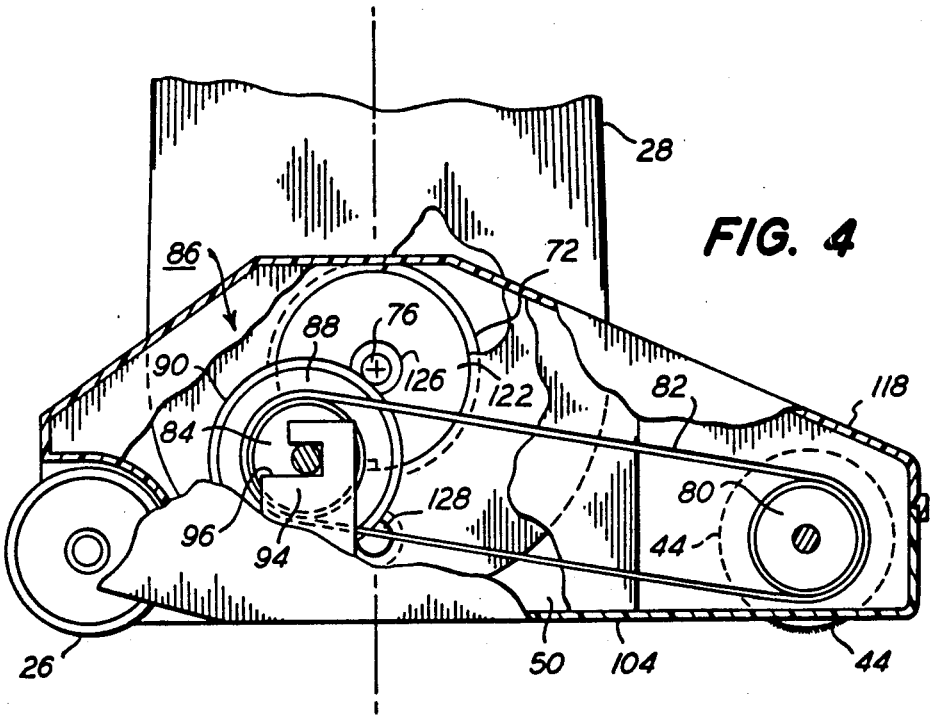
FIG. 4 is a view similar to FIG. 3 showing the position of the brush drive mechanism when the canister is upright and the vacuum cleaner is in its "off" position.

As shown in FIGS. 2, 3 and 4, the housing 24 is essentially U-shaped with the brush chamber 42 in the base of the "U". Leg sections 48 and 50 of the housing 24 extend rearwardly. These sections have interior walls 52 and 54 between which the canister 28 is disposed.

One of these leg sections has a foot pedal actuated, latch mechanism 60 which supports the canister in its upright and forward positions. The canister is free to tilt rearwardly so that it can be brought down close to the floor, restrained only by the hose section 40, so as to enable the vacuum cleaner to be moved under objects, such as beds, during floor cleaning operations.

The brush 44 is rotatably mounted in bearings connected to the outer side walls of the housing 24. One of these bearings is shown in FIG. 2. The nozzle chamber 42 is sealed by packing 64. The packing is shown near one end of the brush 44. The chamber 42 communicates with the hose section 40 through a lateral hose section (not shown) which extends through the leg 48 and into the brush chamber 42. The bristles of the brush 44 extend downwardly through the bottom of the chamber 42 and agitates the rug or other floor covering being cleaned. The housing rides on the brush and on the rear wheels 26.

The canister 28 is a shell having front and back halves 66 and 68 which are assembled together. Partitions in the lower end of the canister provide a cradle 70 for an electric motor 72. This is the only motor in the vacuum cleaner 20. Shafts 74 and 76 extend in opposite directions from the opposite ends of the motor 72. A fan or air pump 77 is attached to the shaft 74 which extends from one of the ends of the motor 72. This fan creates the vacuum which is pulled through the dust bag in the canister. The bag filters and collects the dust and other particles which are drawn through the hose 30 (FIG. 1) either from the floor unit housing 24 or through the tools which are connected to the hose 30. The fan, therefore, remains clean. Shaft 76, which extends from the opposite end, drives a belt and pulley assembly 78.

Figure 7:
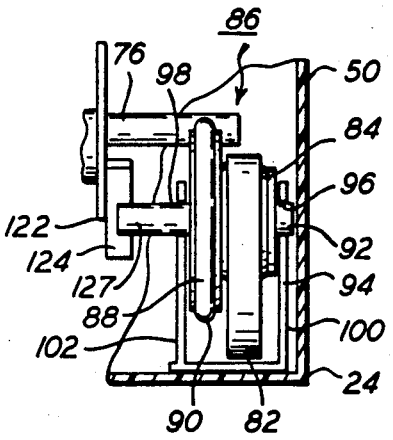
FIG. 7 is a fragmentary sectional view taken along the line 7—7 in FIG. 2.

This assembly 78 is located in the leg 50 of the housing 24. It includes a pulley 80 provided as an extension from the end of the brush 44. This pulley 80 is preferably crowned to locate a belt centrally thereon. The belt 82 of the belt pulley assembly 78 is entrained on a pulley 84 of a pulley assembly 86 which is also shown in FIG. 7 and in other views. An extension 88 in the form of a roller from one side of a pulley 84 has a tire 90, preferably an "O"-ring of polyurethane, mounted thereon. This roller is engaged, at its rim on the tire, by the shaft when the canister 28 is tilted rearwardly for floor cleaning operations. The roller 84 and its extension 88 are rotatably mounted on a sleeve bearing which is journaled on a pin 92 and rotate about the pin 92 as an axle.

The pin 92 is mounted in notches 96 and 98 of upstanding legs 100 and 102 of a bracket 94. The bracket is connected to the floor 104 of the housing leg 50. The belt 82 is made of elastic material and biases the pin and the pulley assembly 86 toward the forward edge 106 of the notches 96 and 98. The belt 82 may readily be replaced by lifting out the brush and looping the belt 82 over the brush pulley 80 and over the pulley assembly pulley 84. The pulley assembly 84 is then pulled back and inserted in the notches 96 and 98 to complete reassembly of the belt and pulley assembly, of course, after the brush has been replaced in its bearing 62.

The axis of the motor 72 and its shafts 74 and 76 is disposed about the axis of rotation (tilting) of the canister 28. The canister's axle is provided by trunnions or axle sections 108 and 110 which extend through openings 112 and 114 in the inner walls 52 and 54 of the housing legs 48 and 50. The housing 24 has a lower part 116 and an upper part 118 which snap together. When the upper part is removed, a generally hemispherical receptacle, which provides the lower end of the openings 112 and 114, is presented for receiving the axle sections 108 and 110 of the canister 28. Then the upper part 118 is placed on and snapped onto the lower part 116 to capture the canister in place.

The axle sections 108 and 110 have flanges 120 and 122 which capture the canister 28 between the side walls thereof and the flanges 120 and 122 and prevent any significant lateral movement of the canister. The shaft 76 extends through an opening 126 in the axle section 108 and in the flange 122. A member 124 is disposed on the flange and may be molded integrally therewith. The member 124 is eccentrically located with respect to the axis of the shaft 76. This member defines a cam surface for engaging the pin 92 as the member moves with the canister through an arc between positions where the canister is tilted forwardly for above the floor cleaning operations and positions where the canister is tilted rearwardly. Contact with the pin is only made when the canister is tilted forwardly (see FIG. 12 and FIG. 3). The cam member 124 is clear of the pin when the canister is in its upright position as shown in FIG. 10 and in FIG. 4 and when the canister is tilted rearwardly from the upright position as shown in FIG. 11 and FIG. 3. In the upright and rearward positions, the elasticity of the belt 82 biases the pulley assembly 86 forwardly into the notches 96 and 98 and against the forward edges 106 of the notches. Then the elasticity of the belt provides the bias which brings and holds the tire 90 on the pulley extension 88 in contact with the motor shaft 76. The brush is then driven.

When the canister is tilted forwardly, as shown in FIGS. 5 and 12, the cam member 124 engages the pin 92 near its inward end 126, thereby tilting the pulley assembly 86 about the forward edge 106 of the notch 96 and disengaging the tire 90 from the shaft 76. The brush is then decoupled and the load on the motor 72 is removed. The motor then speeds up and provides greater suction in the canister for above the floor cleaning operations.

It will be observed that relatively few additional parts than those required for belt drive of the brush are needed in order to provide the mechanism for decoupling the brush when above cleaning operations are selected.

Figure 8:
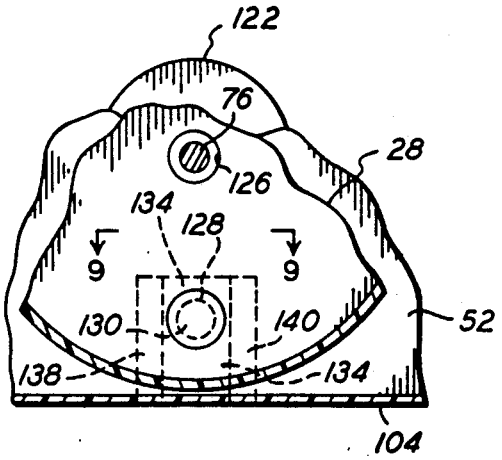
FIG. 8 is a fragmentary sectional view taken along the line 8—8 in FIG. 2.
Figure 9:
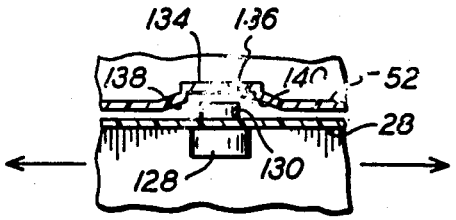
FIG. 9 is a fragmentary sectional view taken along the line 9—9 in FIG. 8.

The vacuum cleaner 22 also has the facility for automatically turning off the motor 72 when it is in the upright position and automatically turning the motor on when the canister 28 is tilted either in the forward or rearward direction. This mechanism utilizes an electrical switch 128 which is mounted on the wall of the canister facing the inner wall 52 of the housing leg 50. This switch is generally cylindrical and has its axis along the center line of the canister 28 which extends through the axis of the shaft 76. The switch is shown in FIG. 3 and also in FIGS. 4, 8 and 9. The switch is a momentary switch of the type which is generally available. It closes its contacts when the button 130 is depressed and opens its contacts when the button 130 is released. A spring in the switch biases the button towards its released position. This push button 130 extends into a cam 134 which is formed at the lower end, near the floor 104, of the housing and in the surface of the interior wall 52 which faces a side of the canister 28.. The switch button 130 projects through the side of the canister and beyond the surface of the inner wall 52. The cam 134 is generally trapezoidal in cross-section and has a centered depression 136 and side ramps 138 and 140. Accordingly, when the canister is in the upright position, the switch button 130 enters the depression 134 and the switch is off. The motor is then turned off and the vacuum cleaner is inoperative. When the canister is tilted either forwardly or rearwardly, the button 134 is cammed inward by the ramps 138 or 140 and the switch is turned on thereby energizing the motor by connecting it through the switch to the power lines.

Figure 6A:
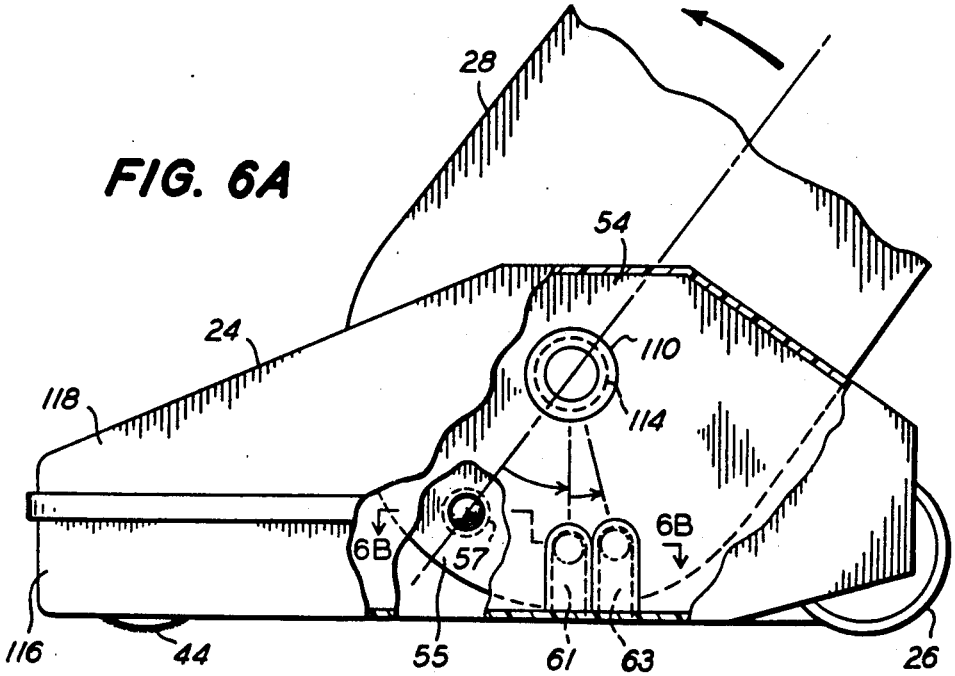
FIG. 6A is a view, similar to FIG. 6, showing another latch arrangement.
Figure 6:
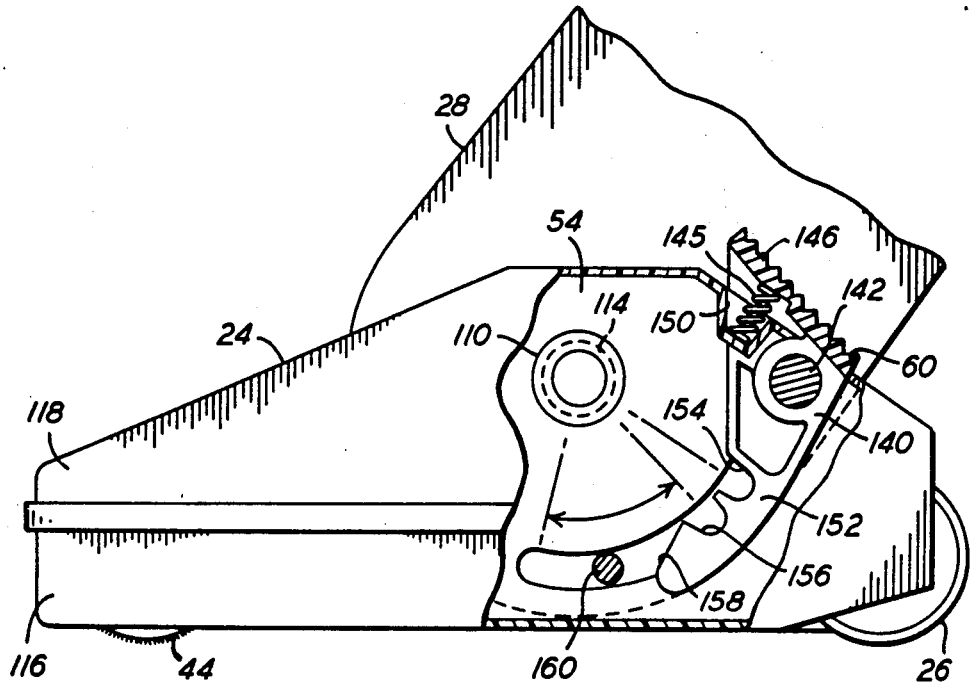
FIG. 6 is a side view of the lower portion of the vacuum cleaner shown in FIG. 1, the view being taken from the right side and being broken away to show the latch arrangement.

Referring to FIG. 6, the latch mechanism 60 is shown. It includes a detent lever 140 which is pivotally mounted on a rod 142 in the housing 24. The lever has a foot pedal arm 146 which is serrated at its top. A compression spring 148 is captured between this arm 146 and a notch 150 at the top of the housing 24. The detent lever 140 is therefore biased in the clockwise direction, as shown in FIG. 6. The lower arm 152 of the detent lever is provided with a pair of notches 154 and 156. The front end 158 of the lower arm 152 is tapered outwardly and is engagable with a pin 160 which extends from the side wall of the canister through the interior side wall 54 of the housing leg section 48.

Accordingly, when the canister 28 is tilted rearwardly, as shown in FIG. 6 the detent lever 140 is clear of the pin 160 and the canister is free to tilt downwardly toward the floor. When the canister is tilted in the forward direction, the pin 160 cams the detent lever backwardly against the bias of the spring 148. The detent snaps forwardly to capture the pin in the first notch 156 when the canister reaches the upright vertical position. In order to tilt the canister forwardly, the pedal 146 is depressed to release the latch 60. The canister may then be tilted forwardly approximately 12 to 15 degrees from the upright position thereof until it reaches the second notch 154 which captures the canister in its forward position. The canister can therefore be locked in either its upright or forward position as desired.

Figure 6B:
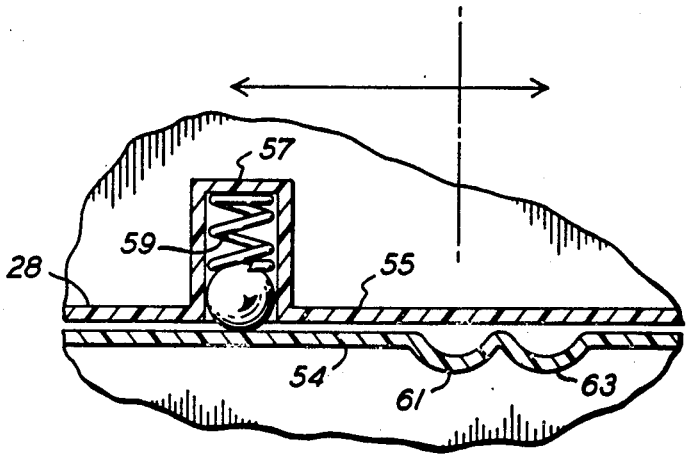
FIG. 6B is a fragmentary, sectional, plan view showing the other latch arrangement where the canister is in its upright position.

Referring to FIGS. 6A and 6B, there is shown another latch mechanism without a foot pedal release. The side wall 55 of the canister 28 has a receptacle 57 for a ball and spring assembly 59. Detent notches 61 and 63 in the inside wall of the leg 48 capture the ball in the upright and forwardly tilted position of the canister.

From the foregoing description it will be apparent that there has been provided an improved vacuum cleaner which is convertible in operation and provides the features of both a canister and a upright floor type vacuum cleaner. The invention provides for a simple design which may be implemented and manufactured at lower cost with few parts, most of which may be molded plastic parts. While an exemplary and presently preferred embodiment of the invention has been described, it will be appreciated that modifications and variations therein within the scope of the invention will become apparent to those skilled in the art. Accordingly, the foregoing description should be taken as illustrative and not in a limiting sense.

We claim:

1. In a vacuum cleaner having a lower body moveable along the floor, a brush rotatably mounted in said lower body and extending from the bottom thereof toward the floor, an upper body mounted on said lower body for tilting movement about an axis, a motor and fan assembly associated with said upper body for pulling a vacuum therein, said upper body being selectively connectable and disconnectable in vacuum communicating relationship with said lower body, respectively for floor cleaning and above the floor cleaning operations, the improvement comprising a mechanism for driving said brush having a member connected to said upper body and extending therefrom into said lower body said member being disposed eccentrically with respect to said axis and being moveable about an arc between positions on one side of a given position to provide for floor cleaning operation to a second position when said upper body is tilted in a direction opposite to said one direction from said given position to provide for said above the floor cleaning operation, means for coupling said motor to said brush including a belt and a pulley assembly moveably mounted in said housing, said pulley assembly having a pin, a pulley around which said belt is entrained, said pulley being rotatably mounted on said pin, said pulley having an extension roller also rotatably mounted on said pin, said motor having a shaft engagable with said extension roller, said pin being engagable by said member when said upper body is tilted in said opposite direction to move said pulley assembly away from said motor shaft and disengage said motor shaft from said extension roller thereby disconnecting driving power from said brush.

2. The improvement as set forth in claim 1 wherein said upper body is a canister and said lower body is provided by a housing having said brush and said belt and pulley means mounted therein.

3. The invention as set forth in claim 2 wherein said housing has a chamber defining a nozzle in the floor thereof, said brush being disposed in said chamber.

4. The improvement as set forth in claim 2 wherein said housing has a forward portion in which said brush is journaled and legs extending rearwardly from said forward portion and defining opposite sides of said housing, and said canister being journaled between said legs.

5. The invention as set forth in claim 4 wherein said pulley and belt means is disposed in one of said legs, said motor shaft extending into said one leg.

6. The improvement as set forth in claim 2 wherein a hose is provided which is connected to said canister and is selectively connectable and disconnectable from said housing for communicating vacuum from said canister to the vicinity of said brush in said housing.

7. The improvement as set forth in claim 2 further comprising a latch mechanism including a detent lever journaled in said housing, said lever having a foot pedal arm and a latching arm including a plurality of notches, a pin extending from said canister and engagable with said detent arm and capturable in said notches.

8. The improvement as set forth in claim 2 further comprising a ball and spring assembly captured in a first wall of one of said canister and housing which opposes a second wall in the other of said canister and housing, detent notches in the said second wall disposed to capture said ball when said canister is in said given position and in the position to which said canister is tilted for above the floor cleaning operation.

9. The improvement as set forth in claim 1 wherein said one direction is the rearward direction, said given position is the upright position of said upper body and said opposite direction is the forward direction.

10. The improvement as set forth in claim 1 wherein said upper body is a canister having trunnions extending therefrom on which said canister is tiltably mounted in said lower body, one of said trunnions having a flange extending into said lower body and presenting a cam which provides said member.

11. The improvement as set forth in claim 10 wherein said motor shaft extends along said axis through said trunnion and said flange.

12. The improvement as set forth in claim 11 wherein said motor shaft has portions extending in opposite directions from the opposite ends of said motor, one of said portions being disposed in said upper body and having said fan attached thereto, the other portion of said shaft extending into said lower body and being engagable with said extension of said pulley.

13. The improvement as set forth in claim 1 wherein said coupling means comprises an extension of said brush which defines a second pulley, said belt being entrained around said first and second pulleys.

14. The invention as set forth in claim 13 wherein said pulley assembly further comprises a bracket connected to said housing in which said pin, said roller and said extension roller is moveably mounted.

15. The improvement as set forth in claim 14 wherein said bracket has a pair of legs, said legs having notches therein, said pin being moveably mounted in said notches, said belt being elastic and biasing said pin into said notches.

16. The invention as set forth in claim 15 wherein said extension roller is a roller attached to one side of said pulley, a tire of resilient material on the periphery of said roller, said tire being engagable with said motor shaft.

17. The improvement as set forth in claim 1 wherein said lower body and upper body have walls disposed adjacent to each other, a switch for connecting electric power to said motor mounted in one of said lower and upper body, said switch having an actuating member projecting from one of said walls toward the other said walls and moveable between "on" and "off" positions, the other said walls having a cam surface engagable with said switch for moving said switch from its "off" position when said upper body is in its given position to its "on" position when said upper body is tilted in either of said opposite directions from said given position.

18. The improvement as set forth in claim 17 wherein said upper body is a canister having side walls, said lower body is a housing having a nozzle chamber containing said brush and leg sections extending from said nozzle section, said leg sections having interior side walls, said canister being journaled in said interior side walls with the side walls of said canister disposed adjacent to the interior side walls of said leg sections for said tilting movement, said switch being mounted upon one of said side walls of said canister eccentrically with respect to said axis and with the actuating member of said switch projecting toward the interior side wall of the one of the said leg sections adjacent thereto, said cam surface being defined by a surface generally trapezoidal in cross-section which defines a depression receiving the actuating member in its "off" position when said canister is in the upright position and having ramps for engaging and actuating said switch actuating member to its "on" position when said canister is tilted forwardly or rearwardly from its upright position.

* * * * *